United States Patent [19]

Kallay

[11] Patent Number: 4,591,955

[45] Date of Patent: May 27, 1986

[54] ILLUMINATING DEVICE PRODUCING A RIPPLE EFFECT

[76] Inventor: Adam G. Kallay, 6075 Wilkinson Rd., Clinton, Wash. 98236

[21] Appl. No.: 643,777

[22] Filed: Aug. 24, 1984

[51] Int. Cl.[4] ..... F21V 33/00

[52] U.S. Cl. ..... 362/101; 362/35; 362/96; 362/125; 362/320; 362/360; 362/806; 40/438

[58] Field of Search ..... 362/101, 96, 125, 35, 362/806, 320, 360; 40/438

[56] References Cited

U.S. PATENT DOCUMENTS

| | | | |
|---|---|---|---|
| 1,777,944 | 10/1930 | Trovato | 362/101 X |
| 1,835,311 | 12/1931 | Krakav | 362/101 X |
| 3,156,417 | 11/1964 | Kemp et al. | 362/125 X |
| 3,538,323 | 11/1970 | Ziegler | 362/806 |
| 4,081,666 | 3/1978 | Roehrick | 362/806 X |
| 4,167,074 | 9/1979 | Cardarelli | 40/438 |

*Primary Examiner*—Peter A. Nelson

*Attorney, Agent, or Firm*—David L. Garrison

[57] ABSTRACT

The present invention relates to an illuminating device that will create a continuously moving ripple effect on the area illuminated. The device comprises a patterned endless belt transported on a pair of driven rollers. One side of the belt is illuminated preferably by a point light source. As the belt is driven, the patterns on the two sides pass each other in opposite directions. This creates a rippled light effect. The device is particularly well adapted for use with an aquarium to simulate underwater, the effect caused by ambient light shining through surface ripple and waves upon the bottom of a body of water.

11 Claims, 3 Drawing Figures

ILLUMINATING DEVICE PRODUCING A RIPPLE EFFECT

BACKGROUND OF THE INVENTION

The present invention relates to an illuminating device that will create a continuously moving ripple effect on the area illuminated. The device is particularly well adapted for use with an aquarium to simulate underwater the effect caused by an ambient light shining through surface ripple and waves.

The present inventor is unaware of any known system within the prior art that will simulate the shimmering effect seen on underwater objects when ambient light passes through the ripple or other wind disturbance normally found on a body of water. Various devices have been described to achieve changing light patterns for other purposes. One of these is described in U.S. Pat. No. 2,281,790 to Newhall. This is a relatively complex device which comprises an assemblage of different colored lamps which are rotated behind a patterned disk which is also rotated but at a different speed from the lamps. In U.S. Pat. No. 3,080,474, Allen describes a light source having a stroboscopic component. This is located behind rotating pattern and color disks. The patterned disk rotates at a multiple of the line frequency, while the color disk rotates a a different speed. Smith, in U.S. Pat. No. 3,308,872, shows an ornamental window shade. This is essentially a roller blind contained in a frame with translucent or transparent screens on either face of the frame. These can be rolled to present different ornamental scenes.

Various inventors have dedicated their effort to supply lighting systems for aquariums. The following U.S. patents are representative U.S. Pat. Nos.: Bovio—3,622,777; Hall—3,805,740 /and 3,913,526; Ritzow et al.—3,836,765; Huyler—3,892,199; Akers—4,078,522; and Roehrick—4,133,024. All of the above described illumination systems are of the type which are placed over or behind an aquarium. Szilagyi, in U.S. Pat. No. 3,563,204 shows an illumination system placed under an aquarium.

None of the systems described above are capable of simulating the shimmering effect of light shining through surface water. In addition, a number of the systems; e.g., those taught by Newhall U.S. Pat. No. 2,281,790, and Allen are relatively complex and expensive to construct. All of the above deficiencies are overcome by the present illumination system.

SUMMARY OF THE INVENTION

The present invention is an illuminating device which, as a key component, has a series of light transmitting geometric patterns formed on an endless belt. The background portion of the belt is of relatively lower light transmission than the geometric patterns areas. The belt is installed on a roller-type drive system so that it is formed into a continuously movable loop having generally parallel first and second face areas. A motor is coupled to the rolls so as to drive the belt at a relatively low speed. The motor can be either variable or constant speed types. Illumination is provided by a light source placed adjacent to the first face area of the pattern. When the belt is set in motion by the drive means, the designs on the first and second face areas will move past each other in opposite directions. Light shining through these moving geometric design area will create a continuous moving ripple effect on an illuminated zone adjacent to the second face area.

The nature of the ripple effect can be controlled by the size and shape of the high light transmitting geometric designs and by the nature of the background portion of the endless belt. The background itself may be essentially opaque or it may be a colored transparent or translucent material which can provide a lighting effect on which the rippled light is superimposed.

One means of making the geometric patterns is by silk screening the desired configuration on the base material. The composition of the base material is not critical. Polyethylene terephthalate film has been found to be especially satisfactory because of its durability. Another method of forming the geometric designs is by die-cutting or otherwise completely removing areas from colored or opaque base material.

In one version of the invention the geometric design areas are randomly placed on the pattern. In another version they are located in generally parallel rows. The designs can be of many geometric shapes. One which produces a particularly pleasing ripple effect are crescents. These are generally arranged with their points lying on a line which is transverse to the direction of movement of the pattern belt.

The nature of the light source is not particularly critical. A light which approximates a point source, such as a single incandescent bulb, is generally preferred.

When used in combination with an aquarium, it is desirable that the illuminating device be contained within an enclosure which is water resistant in order to reduce any possible hazard from electrical shock.

It is an object of the present invention to provide an illumination source which will present a pleasing ripple effect upon the area illuminated.

It is another object to present an illumination source of the type above which can be simply and inexpensively constructed.

These and many other objects will become immediately apparent to those skilled in the art upon reading the following detailed description taken in conjunction with the drawings.

DESCRIPTION OF THE PREFERRED EMBODIMENTS

Figure 1:
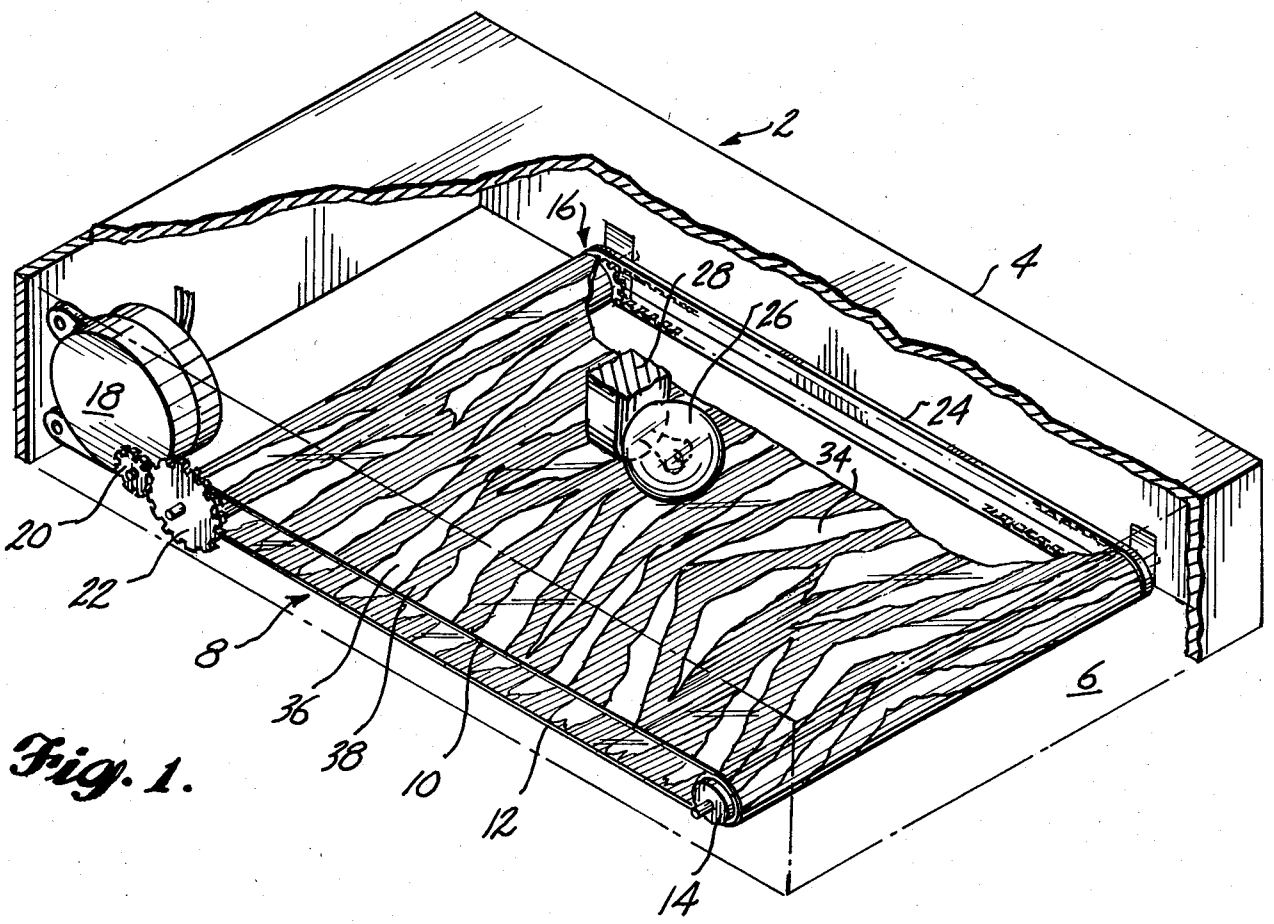
FIG. 1 is a perspective view, partially cut away, of the illuminating device of the present invention.

Referring now to the drawings, the illuminating device is generally indicated at 2. It comprises an opaque housing of which can conveniently be made of sheet metal or molded plastic. The device may optionally have a transparent window 6. An endless belt, generally indicated at 8, is positioned around rollers 14 and 16. The belt has an upper face 10 and a lower face 12 which lie in planes essentially parallel to each other. Roller 16 is driven by a small synchronous motor 18 which is coupled to the roller by gear train 22. Rollers 14 and 16 are connected by a light rubber belt 24 so that the patterned belt 8 is not required to serve a driving function. A small lamp 26 is held within housing 28. This lamp is conveniently a clear bulb having, for example, about 6 to 10 watts power consumption for a typical small aquarium.

Figure 2:
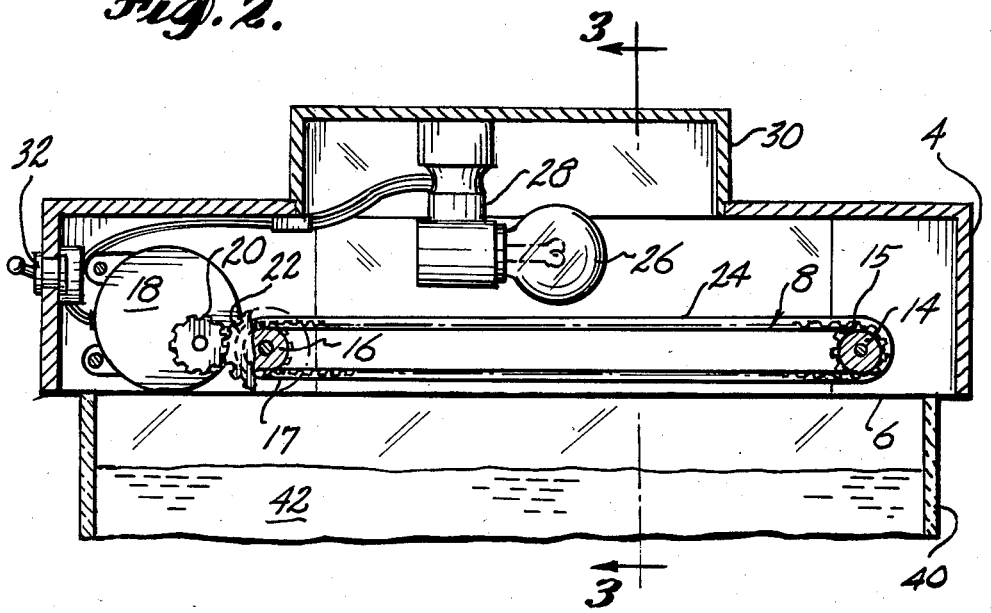
FIG. 2 is a longitudinal section of the illuminating device shown resting on the top of an aquarium.

The lamp 26 and drive motor 18 are both controlled by a switch 32 (FIG. 2). Patterned belt 8 is shown with a double row of crescentic patterns 34, 36 placed on a darker background 38. This background may be either opaque or colored as long as it has relatively lower light transmission than the patterns.

Figure 3:
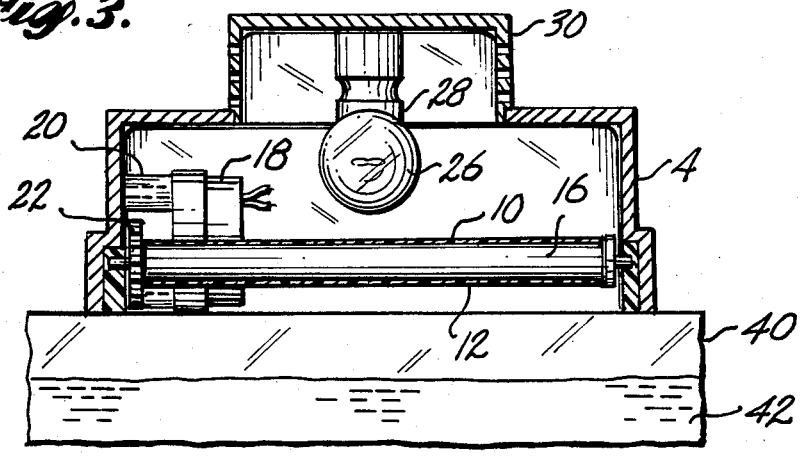
FIG. 3 is a transverse section taken along line 3—3 of FIG. 2.

In FIGS. 2 and 3 the illuminating devices shown are resting on an aquarium 40 containing water 42.

The speed of the belt is not critical and can be readily adjusted according to the desires of the user. This can be accomplished either by using a variable speed motor or by changing the ratio of gears 20, 22. A belt speed of approximately 5 cm/sec has been found to give excellent results.

Due to the relatively slow speed of patterned belt, tracking is not normally a problem. However, it is useful to place flanged ends 15, 17 on rollers 14, 16 to prevent sideways belt travel.

The patterns imprinted on endless belt 8 can be of an almost infinite variety. One which gives a particularly pleasing effect is the use of patterns which are crescentic in nature. These crescentic patterns are most effective when they are positioned so that the tips of the crescents fall on a line that is approximately transverse to the direction of movement of the patterned belt. In use, the first and second face areas of the belt will be moving past each other in opposite directions. The individual crescentic patterned areas will be varying continually as the effective apparature between them opens and closes.

While the patterned belt may be made of any flexible transparent material, polyethylene perephthalete film has proved to be an excellent choice because of its ready availability and long life. It is convenient to silkscreen the desired pattern on the base material. The ends can be readily adhesively bonded to form the desired loop configuration.

As will be readily apparent to those skilled in the art, the iluminating device will have many uses beyond aquarium lighting. Further, many variations can be made in the construction of the device without departing from the spirit of the invention. It is the inventor's intention that the scope of the invention be limited by the following claims.

What is claimed is:

1. An illuminating device which comprises:

a. an endless belt-type pattern means, said means having a background portion of relatively lower light transmissivity with the remaining area of the pattern means being comprised of a multiplicity of geometric design areas of relatively higher light transmissivity;

b. drive means for the pattern means, said drive means comprising roller-type supporting means arranged to hold the pattern means in the form of a continuously moveable loop having generally parallel first and second face areas and further comprising motor means to drive the roller-type supporting means; and c. a light source adjacent to the first face area of the pattern means whereby, when the pattern means is moved by the drive means, the geometric design areas on the first and second face areas will move past each other in opposite directions and the light shining firstly through the moving geometric design areas of the first face area, and thence through the moving geometric design areas of the second face area, will project a continuously moving ripple effect pattern upon an illuminated zone, said illuminated zone being located beyond said second face area of said pattern means.

2. The illuminating device of claim 1 wherein the background portion of the pattern means is a essentially opaque.

3. The illuminating device of claim 1 wherein the background portion of the pattern means is a colored transparent or translucent material.

4. The illuminating device of claim 1 wherein the geometric design areas are randomly placed on the pattern means.

5. The illuminating device of claim 1 wherein the geometric design areas are placed in generally parallel rows on the pattern means.

6. The illuminating device of claim 4 in which the geometric design areas are essentially crescentic in form, said crescents being generally arranged with their points on a line transverse to the direction of movement of the pattern means.

7. The illuminating device of claim 5 in which the geometric design areas are essentially crescentic in form, said crescents being generally arranged with their points on a line transverse to the direction of movement of the pattern means.

8. The illuminating device of claim 1 wherein the light source is essentially a point source.

9. The illuminating device of claim 1 wherein the device is contained within a water resistant enclosure.

10. The illuminating device of claim 9 further in combination with an aquarium.

11. An illuminating device for an aquarium which comprises:

a. light transmissive pattern means, said means having generally parallel first and second face areas adapted to move past each other in opposite directions and having background portions of relatively lower light transmissivity with the remaining area of the pattern means being comprised of a multiplicity of geometric design areas of relatively higher light transmissivity;

b. drive means for the pattern means, to cause said generally parallel first and second face areas to move past each other in opposite directions; and a light source above the first face area of the pattern means whereby, when the pattern means is moved by the drive means, the geometric design areas on the first and second face area, will project a continuously moving ripple effect pattern upon an illuminated zone, said illuminated zone being located below said second face area of said pattern means.

* * * * *